US009744547B1

(12) United States Patent
Czarnecki

(10) Patent No.: US 9,744,547 B1
(45) Date of Patent: Aug. 29, 2017

(54) PROTECTIVE SHIELD FOR PAINTING AND THE LIKE, AND METHOD OF USE

(71) Applicant: David J. Czarnecki, Manchester, CT (US)

(72) Inventor: David J. Czarnecki, Manchester, CT (US)

( * ) Notice: Subject to any disclaimer, the term of this patent is extended or adjusted under 35 U.S.C. 154(b) by 28 days.

(21) Appl. No.: 14/545,591

(22) Filed: May 26, 2015

(51) Int. Cl.
*B05B 15/04* (2006.01)

(52) U.S. Cl.
CPC ..... *B05B 15/0456* (2013.01)

(58) Field of Classification Search
None
See application file for complete search history.

(56) References Cited

U.S. PATENT DOCUMENTS

| | | | | |
|---|---|---|---|---|
| 3,633,542 | A | 1/1972 | Read | |
| 3,693,589 | A | 9/1972 | Knox | |
| 4,051,808 | A | 10/1977 | Trupp | |
| 4,248,914 | A | 2/1981 | McClane | |
| 4,357,898 | A | 11/1982 | Fehrenbacher | |
| 4,443,283 | A | 4/1984 | Sarkisian | |
| 4,629,349 | A | 12/1986 | Pitts | |
| 4,791,007 | A | 12/1988 | Gleason et al. | |
| 4,962,722 | A | 10/1990 | Thompson | |
| 5,445,417 | A | 8/1995 | Bromer | |
| 5,468,533 | A | 11/1995 | Lipson | |
| 5,752,589 | A | 5/1998 | Berg | |
| 5,909,979 | A | 6/1999 | Winzen | |
| 5,943,829 | A * | 8/1999 | Wilson | A47G 27/0487 118/504 |
| 6,337,127 | B1 * | 1/2002 | Voss | B05B 15/0456 156/247 |
| 6,808,794 | B1 | 10/2004 | Mattox | |
| 2003/0025317 | A1 | 2/2003 | Yamamoto | |
| 2010/0075051 | A1 | 3/2010 | Darling | |

* cited by examiner

*Primary Examiner* — Charles Capozzi
(74) *Attorney, Agent, or Firm* — Ira S. Dorman

(57) ABSTRACT

A shield unit, intended primarily for the protection of a carpet from the accidental application of paint applied to an adjacent baseboard, and suitable for disposable use, consists of two superposed plies of a film, comprised or consisting of a plastic material, which cooperatively define a plurality of adjacent pockets and have a common, structurally reinforced leading edge. The shield unit is long and narrow, and is constructed to facilitate entry of its leading edge into the effective gap that is normally present between the bottom of a baseboard and a carpet on the floor; the pockets serve to receive the blade of a tool, such as a putty knife, to which force may be applied to assist in pushing the leading edge of the shield into the effective gap. The shield unit may be provided as individual, relatively short sections, typically at least 30 inches long and four inches wide, or longer units may be used to cover an extended length of carpet with a single section. A multiplicity of shield units may be cut or otherwise separated from a continuous length strip, typically at least eight feet long, which may be provided in the form of a roll or a folded stack.

11 Claims, 3 Drawing Sheets

PROTECTIVE SHIELD FOR PAINTING AND THE LIKE, AND METHOD OF USE

BACKGROUND OF THE INVENTION

When a mobile material is to be applied to only one of two adjacent or contiguous surfaces, a virtually universal concern is to protect the other surface against contamination by the material. Painting or staining of the baseboard on a wall, while avoiding accidental application of the paint or stain to the floor or floor covering through inadvertent brush contact, dripping, or the like, is a prime example of the problem—but is hardly the only circumstance in which it is encountered. It is to be understood to references herein to baseboards, floors, and floor coverings are made for convenience and are non-limiting, and that the shield and method described and claimed can be used and applied for any suitable purpose, as will be evident to those skilled in the art.

When painting the baseboard in a room, a common means for protecting the adjacent floor surface employs a hand-held shielding device or tool. Such devices are typically made from aluminum or plastic, and are comprised of a panel having at least one straight edge portion that can be pressed against the baseboard with the main portion of the shield overlying the adjacent floor or floor covering. Representative or prior art disclosing shielding devices of that general character and intended for such use are the following United States published patent documents:

| | |
|---|---|
| U.S. Pat. No. 3,633,542 | U.S. Pat. No. 3,693,589 |
| U.S. Pat. No. 4,051,808 | U.S. Pat. No. 4,248,914 |
| U.S. Pat. No. 4,357,898 | U.S. Pat. No. 4,443,283 |
| U.S. Pat. No. 4,791,007 | U.S. Pat. No. 4,962,722 |
| U.S. Pat. No. 6,808,794 | No. 2010/0075051 |

A major drawback inherent in paint shields of the prior art resides in their relative shortness (typically being about 12 to 18 inches long, as measured along the blade or straight-edge portion), necessitating their frequent repositioning. That procedure is not only inconvenient, awkward, and time-consuming, but moreover it requires the exercise of constant care in placement of the blade against the baseboard; and even then the flooring or floor covering is exposed to paint encroachment and contact as a result of running or dripping of paint or spring-back of the pile of an adjacent (e.g., wall-to-wall) carpet in an area from which the shield has been displaced. Furthermore, if the shield is left in place until the paint is at least semi-dry, adhesion to the shield may cause paint to pull away from the surface.

Some of the foregoing drawbacks inherent in conventional paint shields can be avoided through the use of masking or "painting" tape or, indeed, by simply laying sheets of paper or plastic, or a tarpaulin, edgewise along the baseboard. Again, however, the application of tape is time-consuming, inconvenient, not entirely effective, and impractical under some circumstances; moreover, tape wedged into a gap is likely to tear upon removal and give rise to obvious undesirable consequences. By the same token, unsecured sheets of paper, plastic, and the like are readily distorted and displaced, and are difficult to position so as to provide and maintain accurate lines of demarcation between objective and protected surfaces.

Accordingly, it is a broad object of the invention to provide a shield unit which is effective for the protection of a surface against the accidental application of a mobile material that is intentionally applied to an adjacent objective surface.

A related object of the invention is to provide a product for conveniently supplying such shield units in selectively variable lengths.

Additional related objects are to provide a protective method that utilizes such shield units, and a method for supplying them.

More specific objects of the invention are to provide a shield unit having the foregoing features and advantages, which is facile, fast, and convenient to employ, enables significant job-time reduction, is of incomplex construction and inexpensive manufacture, and is essentially suited for one-time, throw-away use.

BRIEF SUMMARY OF THE INVENTION

It has now been found that certain of the foregoing and related objects of the invention are attained by the provision of a shield unit for the protection of a surface against the accidental application of a mobile material that is intentionally applied to an adjacent objective surface, the protected surface and the objective surface being separated from one another with an effective gap therebetween that extends generally longitudinally at an intersection thereof. The shield unit is long and narrow, and comprises two substantially rectangular superposed plies of a thin flexible film comprised of a synthetic resinous (i.e., plastic) material; the film will normally be at least about three and preferably at least four mils thick, and less than about 10 mils in thickness. The plies of film are connected to one another at a common rectilinear leading edge of the shield unit, and a structurally reinforcing marginal portion extends therealong. They are of substantially the same length and are joined by a multiplicity of mutually spaced transverse bond, or securement, lines that extend across the shield unit to define, between the plies of film, a plurality of pockets that are open adjacent a trailing edge of the shield unit for the receipt of a tool (or a blade-like member thereof) for aiding insertion of the leading edge into such an effective gap.

In preferred embodiments the shield unit is at least 30 inches long and four inches wide. A top ply of the film comprising the shield unit will preferably be substantially narrower than a bottom ply thereof so as to space, or offset, a trailing edge of the top ply away from a trailing edge of the bottom ply and thereby facilitate entry of a tool into each of the plurality of pockets. The multiplicity of intermediate transverse bond lines will advantageously be mutually spaced about two to eight, and preferably three to six, inches from one another, and two of the transverse bond lines will generally be disposed at opposite ends of the unit. Separate lengths of film constituting the plies of the shield unit may be bonded to one another, or a single length of film may be folded, creased, and bonded, in either case providing the leading edge and, at least in part, the structurally reinforcing marginal portion, which portion may be augmented by means such as a row of transversely oriented corrugations or an attached, supplemental layer of film.

The shield unit will beneficially include at least one continuous or discontinuous adhesive element disposed on a lower face of the bottom ply of film, along and adjacent the trailing edge of the shield unit, for securement to the protected surface. Similarly, at least one adhesive element may desirably be disposed on an upper face of the bottom ply of film, along and adjacent the trailing edge, to enable securement of an auxiliary web of material to the shield unit;

such an auxiliary web may be extended beyond the trailing edge of the shield unit to thereby enlarge the area of protection provided.

Other object of the invention are attained by the provision of a shield strip for providing the shield units hereinabove and hereinafter described. Such a shield strip is divisible along its length to provide a plurality (i.e., two or more) of the shield units.

Additional objects of the invention are attained by the provision of a method for the application of a mobile material to an objective surface while protecting an adjacent surface against the accidental application of the mobile material thereto, utilizing the shield unit hereinabove and hereinafter described, the surfaces being separated from one another by an effective gap that extends generally longitudinally at an intersection thereof. The method includes the following steps (in addition to providing the described shield unit): providing a tool having a blade-like member; positioning the shield unit along the effective gap between the surfaces, with the leading edge of the shield unit aligned for entry into the gap; inserting at least the blade-like member of the tool into at least one of the pockets of the shield unit; applying force to the tool so as to cause the blade-like member thereof to push effectively against the marginal portion of the shield unit (from within the pocket) and thereby assist in advancing the leading edge of the shield unit into the effective gap between the objective and protected surfaces; repositioning a bottom ply of the plastic film, if necessary (normally after withdrawing the tool), to cause it to lie substantially flat upon the protected surface; and applying a mobile material to the objective surface.

Generally, in carrying out the foregoing method the objective surface and the protected surface will be substantially perpendicular to one another; and more particularly the objective surface will often be that of a baseboard, the protected surface will be that of a floor or floor covering, and the applied mobile material will typically be paint, varnish, shellac, or stain. In those instances in which the shield unit additionally includes an adhesive element disposed on the upper face of the bottom ply of the film, as described, the method may include further steps of securing an auxiliary web of material to the adhesive element and extending the auxiliary web beyond the trailing edge of the shield unit and over the protected surface.

Objects of the invention are also attained by the provision of a method for the application of a mobile material to an objective surface, while protecting an adjacent surface, in which a shield strip is provided. In addition to the other steps described, such a method will include a step of cutting or otherwise severing the shield strip transversely, at least at one location along its length, so as to provide a plurality of shield units, each having at least one pocket therein, for insertion into the gap between the surfaces involved.

DETAILED DESCRIPTION OF THE INVENTION

Figure 1:
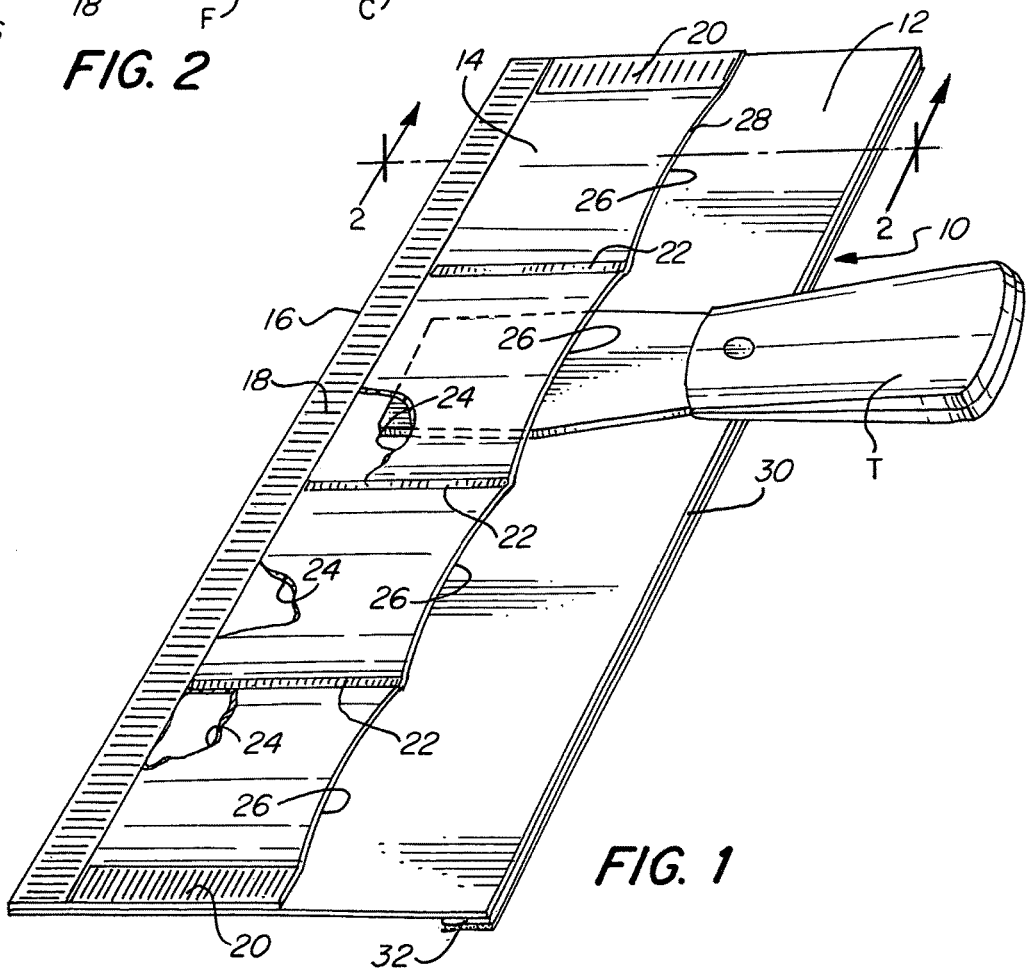
FIG. 1 is a perspective view of a protective shield unit embodying the present invention, shown in combination with a tool inserted into an integral pocket of the shield unit for aiding insertion.

Turning initially to FIG. 1 of the drawings, therein illustrated is a shield unit, generally designated by the numeral 10, embodying the present invention and consisting of a rectangular bottom ply 12 and a rectangular top ply 14, both plies being comprised of a flexible plastic film and the top ply 14 being somewhat narrower than the bottom ply 12. The two plies 12, 14 are connected to one another at a common rectilinear leading edge 16, along which runs a corrugated, structurally reinforcing marginal portion 18.

A bond line 20 extends partially across the shield unit 10 at its opposite ends and provides narrow areas of securement traversing the width of the top ply 14, and three intermediate bond lines 22 extend across the width of the top ply between the opposite ends. The bond lines 20, 22 affix the top ply 14 to the bottom ply 12 at their respective locations so as to define (in the embodiment illustrated) four adjacent pockets 24 along the length of the shield unit. Each of the pockets 24 has an open end 26 at the trailing edge 28 of the top ply 14, which is offset from the trailing edge 30 of the bottom ply 12. This arrangement facilitates entry of the relatively flat, thin, and strait-edged blade of an insertion tool T (e.g., a putty knife) into the pockets 24, with the tool T being used to aid insertion of the leading edge 16 of the shield unit 10 and being moved from pocket-to-pocket 24, as necessary or advantageous. An adhesive strip 32 extends along the underside of the bottom ply 12, and would normally be covered by a removable release element (not shown) of essentially non-adherent material, which would be peeled away in the course of use of the shield unit.

Figure 2:
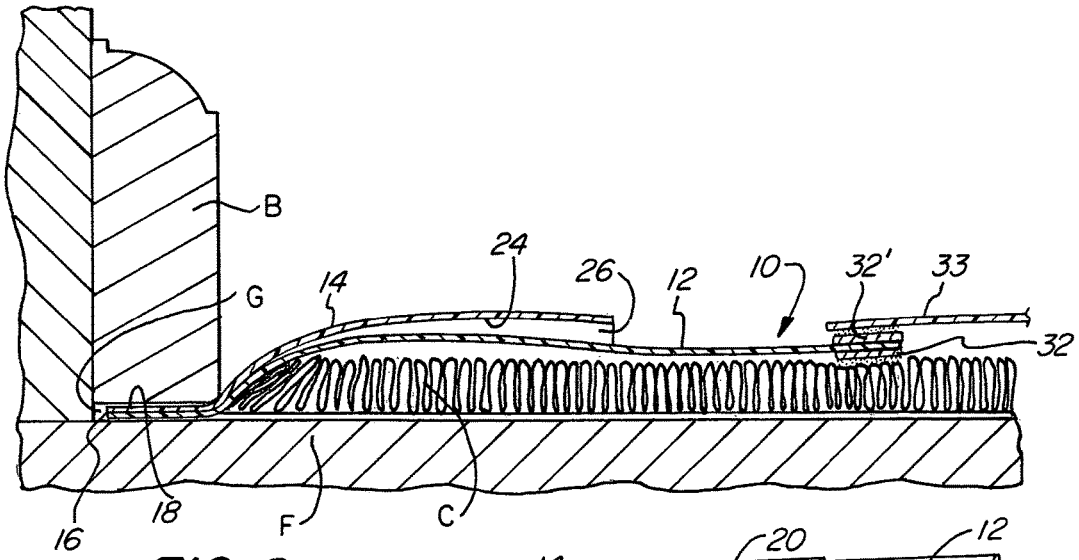
FIG. 2 is a vertical cross-sectional view showing the leading edge and marginal portion of the shield unit of FIG. 1 (with the tool withdrawn) inserted into a gap between the baseboard and the carpeted floor of a room.

As seen in FIG. 2, the leading edge 16 and marginal portion 18 of the shield unit 10 have been inserted in the gap G, which is normally formed between the floor F and the bottom of the baseboard B during construction and is typically about one-quarter to one-half inch wide. The bottom ply 12 of the shield unit is extended to cover the marginal portion of carpet C lying adjacent the baseboard B, whereupon the release element is peeled off to expose the adhesive element 32, thus enabling light securement of the trailing edge portion of the bottom ply 12 to the surface of the carpet C. It will be self-evident that paint or other coating material may then be applied to the surface of the baseboard B, with the carpet C shielded against inadvertent application, dripping, spillage or overspray of paint, etc.

FIG. 2 also depicts a second adhesive element 32' affixed on the upper surface of the bottom ply 12 of the shield unit 10. Again after removal of a release element (not shown), a web 33 of material (e.g., paper, cloth, plastic sheet), shown fragmentarily, is attached to the adhesive element 32' for extension beyond the trailing edge of the bottom ply 12 to thereby enlarge the area of protection afforded to the carpet C.

Figure 3:
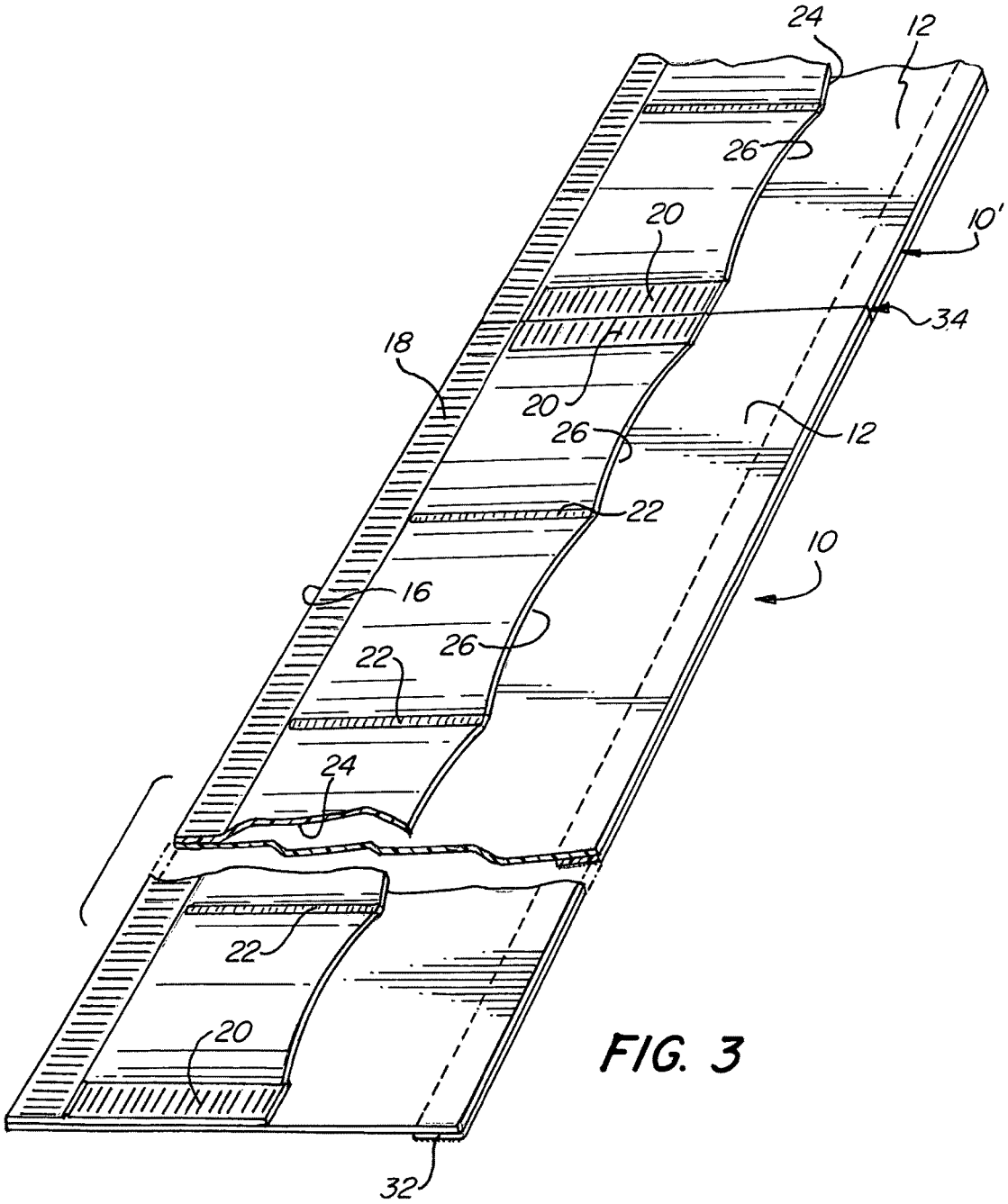
FIG. 3 is a fragmentary perspective view of a shield strip embodying the invention, comprised of a plurality of shields units joined to one another end-to-end.

Turning now to FIG. 3, it is seen that a second, fragmentary illustrated shield unit 10' is connected endwise to the shield unit 10; the fragmentation depicted on shield unit 10 indicates that there may be numerous intervening shield units, thus representing a shield strip, generally designated by the numeral 34, comprised of a multiplicity of shield units. It is evident that the shield strip 34 can be cut or otherwise severed at any suitable location along its length so as to separate one or more of the shield units from the others; this may be facilitated by cutting on, or with reference to, any of the transverse bond lines 20, 22. Thus, if a surface to be painted is longer than the length of an individual shield unit, a section or segment of the shield strip 34 may be separated and employed to cover that entire length, with but a single insertion operation of the leading edge into the wall/baseboard juncture gap. Needless to say, shield units or strip sections may be applied and left in place so as to thereby enable the painter to complete an entire room without interruption, thus affording obvious job-time and work-quality benefits.

Figure 4:
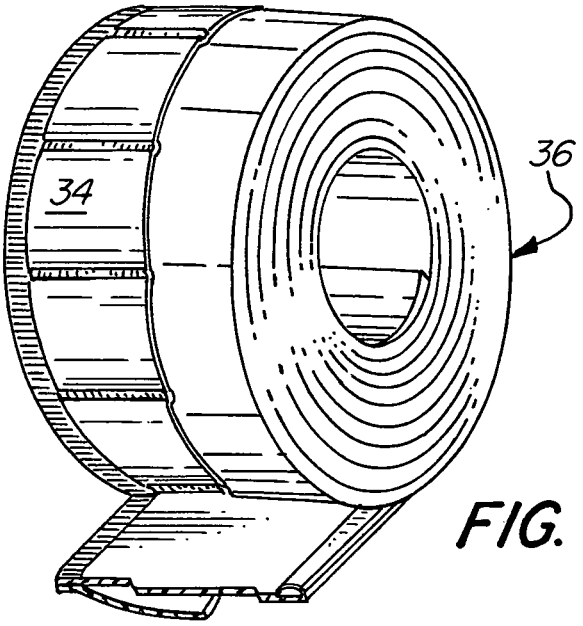
FIG. 4 is a diagrammatic perspective view showing a shield strip embodying the invention in the form of a roll.
Figure 5:
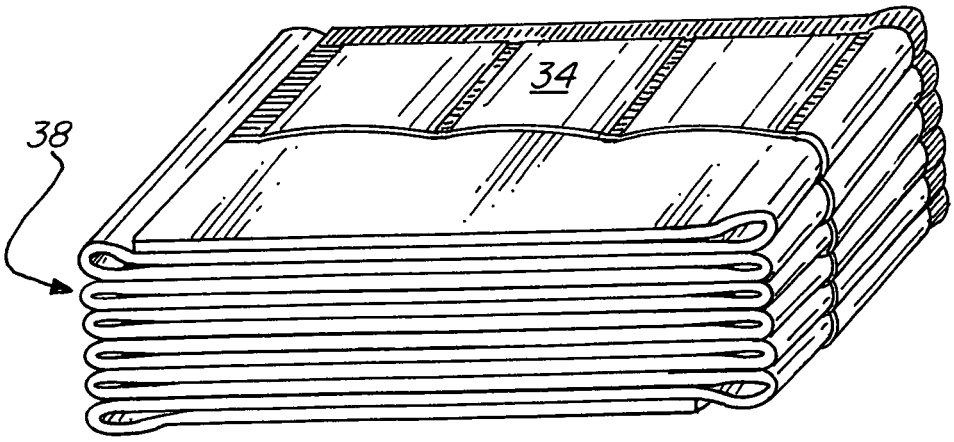
FIG. 5 is a diagrammatic perspective view showing a shield strip embodying the invention in the form of a fan-folded stack.

In FIG. 4, the shield strip 34 is in the form of a roll, generally designated by the numeral 36. In FIG. 5 it is in the form of a fan-folded stack, generally designated by a bracketed numeral 38.

While the plies of the shield unit (and consequently of the shield strip) may be fabricated from a single plastic material, it will be appreciated that they may comprise two or more polymers, and may include (albeit perhaps with excessively reduced flexibility) foil and/or paper lamina. Thermoplastics, such as the polyolefins (e.g., high density polyethylene or polypropylene), will generally be preferred from standpoints of facilitating bonding of the plies to one another under heat and pressure, toughness (even in relatively thin gauges, and especially if the film is biaxially oriented), ready availability, and cost. Moreover, such plastics are typically flexible, and usually exhibit relatively low coefficients of friction, both of which properties are desirable for facilitating insertion of the leading edge of a shield unit into a gap between adjacent surfaces, even when the path to be followed is of compound cross-section. Thus, while the leading edge of the shield unit must be sufficiently rigid to enable ready introduction an insertion without buckling under the forces applied, still it must be able to follow a path within a floor/baseboard construction that may include one or two angle bends. Flexibility of the plastic also promotes a lay-flat condition of the bottom ply on top of the protected surface.

The plies of the shield unit may alternatively be fabricated from thermosetting resins, such as polyesters and silicones, albeit bond lines could not then be produced by thermal fusion. It will be appreciated that securement of the plies to one another may, in any event, be effected by any suitable means including, for example, applications of adhesives or solvents, ultrasonic welding, and mechanical crimping (all such means being encompassed by the term "bonding," as used herein).

Although the plies of flexible film comprising the shield unit will normally be at least about four mils thick, in some instances elements as thin as three mils may be utilized. This will depend essentially upon the toughness and tensile strength of the material and its consequential ability to withstand insertion and withdrawal forces without rupturing or tearing. Plies in excess of 10 mils will usually be too thick.

As a matter of practicality and economy, each shield unit will desirably be at least about 30 inches in length and three to eight, or preferably four to five, inches in width, with an offset of about one-quarter inch to one-inch of the trailing edge of the top ply from the trailing edge of the bottom ply, albeit in some cases introduction of at least the blade of an insertion-assisting tool might be achieved in the absence of any offset.

When provided in the form of a "continuous" strip, the shield will normally be at least eight feet long (corresponding to the full width of a drywall panel), although certainly longer lengths (e.g., 20 feet or more) may be more practical and desirable, depending largely upon the form in which the shield strip is provided.

In most instances, transverse bond lines across a shield unit will be mutually separated by not less than about two, and preferably not less than three, inches, or more than about four, and preferably not more than six, inches. Here again, however, these dimensions may vary, and will depend in part upon the width of the flat forward edge of the tool that is to be used for insertion, and the desired stabilization effect of the bond lines; i.e., if the lines are too far apart the shield unit will tend to distort, whereas if they are too close together the width of the tool blade used would be limited and insertions into an excessive number of pockets might be required. The bond lines will normally be oriented perpendicular to the leading edge of the shield unit, but here again variation is feasible.

As indicated above, the transverse bond lines may provide convenient sites for severance of the shield units from one another, and indeed it may be desirable to provide perforations along a bond line so as to facilitate manual separation of the shield units from one another. As is also described above, continuous-length shield strips will conveniently be provided in roll form or as a fan-folded stack. In such instances, the strip may be contained in a package that facilitates dispensing and that has means for severing the units from one another, such as a cutting bar, serrated edge, etc. Individual shield units may also be packaged so as to provide a range of lengths (e.g., three, eight, 12 and 16 feet), among which selection may be made to obtain a unit or section of optimal length for a given application.

In addition to painting, staining, and the like, the shields of the present invention may, for example, be used for cleaning, recaulking, sanding, etc., among other applications that will be evident to those skilled in the art. Similarly, treatment of trim work, moldings, doorjams, window frames, and the like may employ the shields hereof, and while protection of flooring has been emphasized it will be appreciated that the shields may be employed to protect wall surfaces above baseboards as well. Many variations may occur to those skilled in the art, based upon the present description, without departure from the appended claims Thus, it can be seen that the present invention provides a novel shield unit which is effective for the protection of a surface against the accidental application of a mobile material that is intentionally applied to an adjacent objective surface, and which units may conveniently supplied in selectively variable lengths. The shield units are easily and conveniently employed, are of incomplex construction and inexpensive manufacture, and are essentially suited for one-time, throwaway use. The invention also provides a protective method that utilizes such shield units, and a method for supplying them.

Having thus described the invention, what is claimed is:

1. A shield unit for the protection of a surface against the accidental application of a mobile material that is intentionally applied to an adjacent objective surface, the protected surface and the objective surface being separated from one another with an effective gap therebetween that extends longitudinally at an intersection thereof; said shield unit having a length greater than its width and comprising two substantially rectangular superposed plies of a flexible film that is not less than about three mils thick and is comprised of a plastic material, said plies of film being connected to one another at a common rectilinear leading edge of said shield unit and having a structurally reinforcing marginal portion extending therealong, said plies of film being of substantially the same length and being joined to one another by a multiplicity of mutually spaced transverse bond lines that extend across said shield unit to define, between said plies of film, a plurality of pockets that are open adjacent a trailing edge of said shield unit for the receipt of a tool for aiding insertion of said leading edge of said shield unit into an effective gap.

2. The shield unit of claim 1 wherein a top ply of said film is narrower than a bottom ply of said film so as to space a trailing edge of said top ply away from a trailing edge of said bottom ply to thereby facilitate entry into each of said plurality of pockets.

3. The shield unit of claim 1 wherein said multiplicity of transverse bond lines are spaced about three to six inches from one another.

4. The shield unit of claim 3 wherein two of said transverse bond lines are disposed at opposite ends of said shield unit.

5. The shield unit of claim 1 wherein said shield unit is at least 30 inches long and four inches wide.

6. The shield unit of claim 1 wherein said plies of film are bonded to one another at said leading edge to provide, at least in part, said structurally reinforcing marginal portion.

7. The shield unit of claim 1 wherein said structurally reinforcing marginal portion of said shield comprises a row of transversely oriented corrugations.

8. The shield unit of claim 1 additionally including at least one adhesive element disposed on a lower face of a bottom ply of said film, along and adjacent the trailing edge of said shield unit, for securement of said bottom ply of film to such an adjacent protected surface.

9. The shield unit of claim 1 additionally including at least one adhesive element disposed on an upper face of a bottom ply of said film, along and adjacent the trailing edge of said shield unit.

10. The shield unit of claim 9 additionally including an auxiliary web of material secured to said at least one adhesive element disposed on said upper face of said bottom ply of film and arranged for extension beyond said trailing edge of said shield unit.

11. A shield strip for providing a plurality of shield units, each shield unit being constructed for the protection of a surface against the accidental application of a mobile material that is intentionally applied to an adjacent objective surface, the protected surface and the objective surface being separated from one another with an effective gap therebetween that extends longitudinally at an intersection thereof; said shield strip being at least eight feet long and having a width that is less than its length, and comprising two substantially rectangular superposed plies of a flexible film that is not less than about three mils thick and is comprised of a plastic material, said plies of film being connected to one another at a common rectilinear leading edge of said shield strip and having a structurally reinforcing marginal portion extending therealong, said plies of film being of substantially the same length and being joined to one another by a multiplicity of mutually spaced transverse bond lines that extend across said shield strip to define, between said plies of film, a multiplicity of pockets that are open adjacent a trailing edge of said shield strip for the receipt of a tool for aiding insertion of said leading edge into an effective gap, said shield strip being divisible along its length to provide a plurality of shield units, each having a length greater than its width.

* * * * *